United States Patent [19]

Savitt

[11] 4,239,003

[45] Dec. 16, 1980

[54] METHOD FOR TRANSMITTING DETONATION AT A SHARP ANGLE

[75] Inventor: Jacob Savitt, Capitola, Calif.

[73] Assignee: The United States of America as represented by the Secretary of the Navy, Washington, D.C.

[21] Appl. No.: 933,327

[22] Filed: Aug. 14, 1978

[51] Int. Cl.[3] ..... C06C 5/06

[52] U.S. Cl. ..... 102/27 R

[58] Field of Search ..... 102/27 R, 27 F, 29, 102/23; 86/22

[56] References Cited

U.S. PATENT DOCUMENTS

| | | | |
|---|---|---|---|
| 405,684 | 6/1889 | Smith et al. | 102/28 |
| 1,598,920 | 9/1926 | Mallet | 102/27 F |
| 2,839,997 | 6/1958 | Church et al. | 102/27 R X |
| 2,923,239 | 2/1960 | Andrew et al. | 102/29 X |
| 3,460,477 | 8/1969 | Heidemann et al. | 102/27 R |
| 3,782,284 | 1/1974 | Gibb et al. | 102/27 R |
| 3,991,679 | 11/1976 | Savitt et al. | 102/27 F |
| 4,112,845 | 9/1978 | Savitt | 102/27 R |

FOREIGN PATENT DOCUMENTS 1180037 12/1958 France .

*Primary Examiner*—David H. Brown

*Attorney, Agent, or Firm*—R. S. Sciascia; Charles D. B. Curry; Francis I. Gray

[57] ABSTRACT

A method for transmitting detonation at 90° and other sharp angles by using special end tips. Cylindrical end tip cups are loaded in a shaped die under sufficient pressure to change the shape to a square or rectilinear cross-section. The flat side of one end tip is placed adjacent the end of a second end tip to transmit detonation at a sharp angle.

3 Claims, 6 Drawing Figures

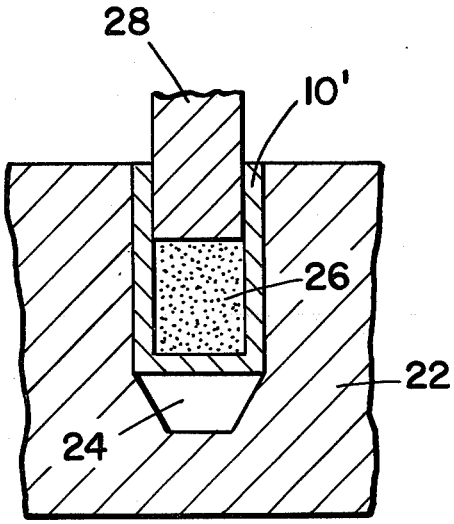
FIG_3(a)
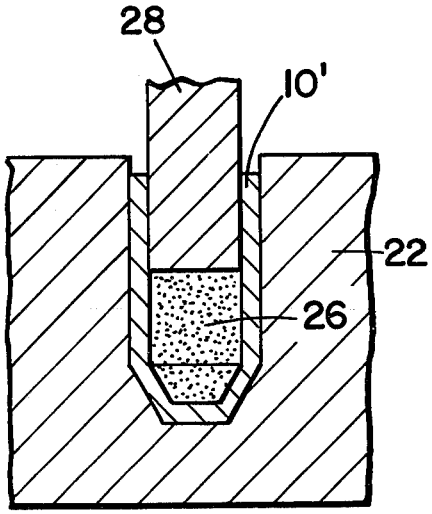
FIG_3(b)
FIG_4(b)
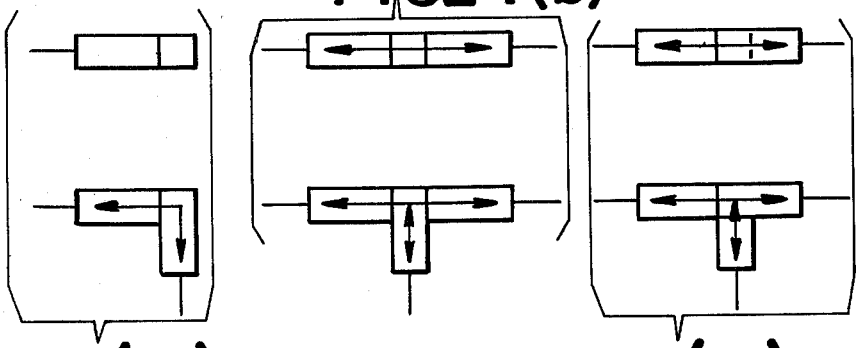
FIG_4(a)
FIG_4(c)
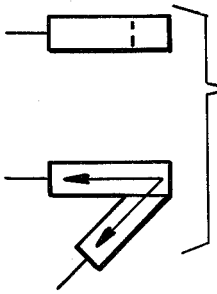
FIG_4(d)

METHOD FOR TRANSMITTING DETONATION AT A SHARP ANGLE

BACKGROUND OF THE INVENTION

1. Field of the Invention

The present invention relates to a method for transmitting detonation, and more particularly to a method for transmitting detonation at a sharp angle.

2. Description of the Prior Art

Previous end tip configurations were cylinders of circular cross-section. A detonation traveling along a detonation transmission line, usually cylindrical in shape, enters the end tip having a larger diameter cylindrical charge. When the detonation reaches the end of the end tip, a shock wave and fragments cross the space between two adjacent end tips. The acceptor end tip is arranged so that it is struck on its side. If the acceptor end tip detonates properly, the detonation travels to the line to which it is connected, making a right angle turn. However, because of the circular cylindrical geometry, the circular cylindrical shape, the explosives in the cups cannot be brought together in uniformly close proximity, i.e., even if the cups touch they touch only along a line of tangency. Everyplace else the explosives in the cups are at different and greater distances apart.

The detonation may travel in the opposite direction, i.e., it may travel from the side of one end tip to the end of the second end tip to make a right angle turn. Even greater difficulties arise in this case for detonation transmission. When detonation transmission occurs from the end of one end tip to the side of another, an almost solid disc is thrown in a compact and straight line with little radial dispersion to strike the acceptor. This disc is effective as an initiator not only because of its ability to carry concentrated (undispersed) energy, but also because its velocity is a maximum because it is pushed by the detonation in the same direction in which the detonation is traveling, the only drawback being that all the fragments do not strike the acceptor simultaneously. However, when the detonation is from the side of one end tip to the end of another, there are many more and smaller fragments which are radially dispersed so the acceptor receives less energy because fewer fragments hit, and those that do hit have a radial velocity component. Furthermore, the velocity of these fragments is not as great as it would be if the detonation which pushed them were traveling in the same direction as the fragments instead of at right angles to that direction.

In addition to making the simple right angle turn, there are other requirements in which the detonation must be able to transmit through a Tee-junction. In this case the inefficiency of the cylindrical surface transmission is involved. Indeed, tests have shown that there are cases in which detonation from a flat end of one end tip is transmitted to the flat end of another end tip successfully 12 times in 12 tries, while when detonation with the same end tips is attempted from the side of a cylindrical end tip to the end of an acceptor end tip, detonation fails 12 times in 12 tries.

SUMMARY OF THE INVENTION

Accordingly, the present invention provides a method for transmitting detonation at a sharp angle by using special end tips. Cylindrical end tip cups are loaded in a die under sufficient pressure to change the shape to a square or rectilinear cross-section so that the surfaces involved in detonation transmission are flat or have other special shapes for greatest efficiency. The end of one end tip is placed adjacent the side of a second end tip, the shapes being such that there is contiguous contact so that the fragments are larger and less dispersed and the acceptors are more effective in receiving the fragments.

Therefore, it is an object of the present invention to provide a method for transmitting detonation at a sharp angle in either direction.

Other objects, advantages and novel features of the present invention will be apparent from the following detailed description when read in view of the appended claims and attached drawing.

BRIEF DESCRIPTION OF THE DRAWING

FIGS. 3(*a*) and 3(*b*) are cross-sectional views of a cylindrical end tip cup in a die (a) before shaping and (b) after shaping.

FIGS. 4(*a*)–4(*d*) are plan and top views of several configurations of the special end tips for (a) right angle transmission, (b) and (c) Tee-junction transmission, and (d) an arbitrary acute angle transmission.

DESCRIPTION OF THE PREFERRED EMBODIMENTS

Figure 1:
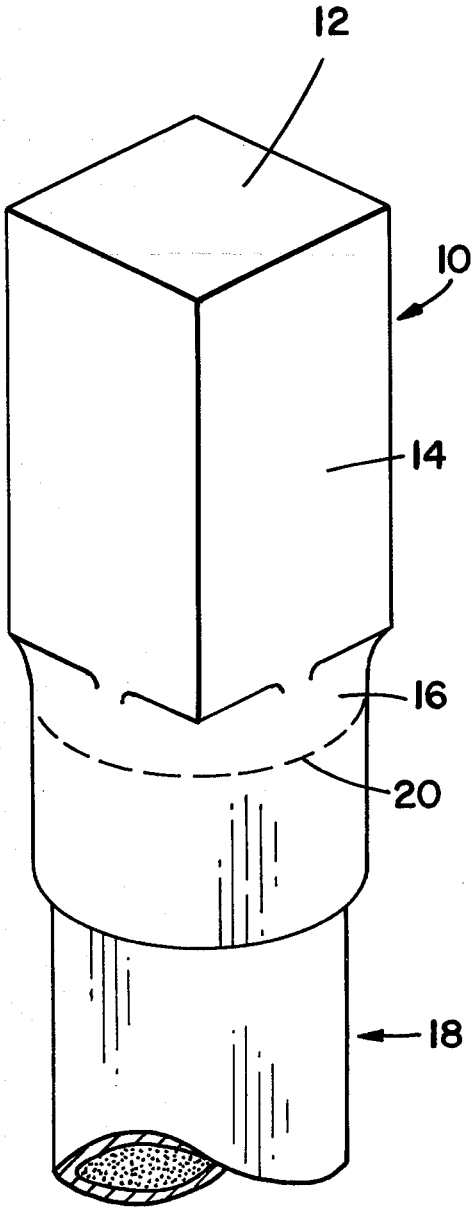
FIG. 1 is a perspective view of a pre-formed end tip cup having a square cross-section.

Referring now to FIG. 1 a special end tip 10 is shown having a square or rectilinear cross-section 12, with flat sides 13, which sides may be concave for special purposes or corregated like rain pipe. The open end has a cylindrical shape 16 for ease of loading the explosive with which it is filled and for joining to a cylindrical detonation transmission line 18 by suitable means, such as crimping, which are well known in the art. The explosive fills the end tip down to the dotted line 20 at which point the detonation transmission line 18 abuts the explosive. The cup, i.e., the end tip 10 without the explosive fill, may be preformed and then loaded with the explosive.

Figure 2:
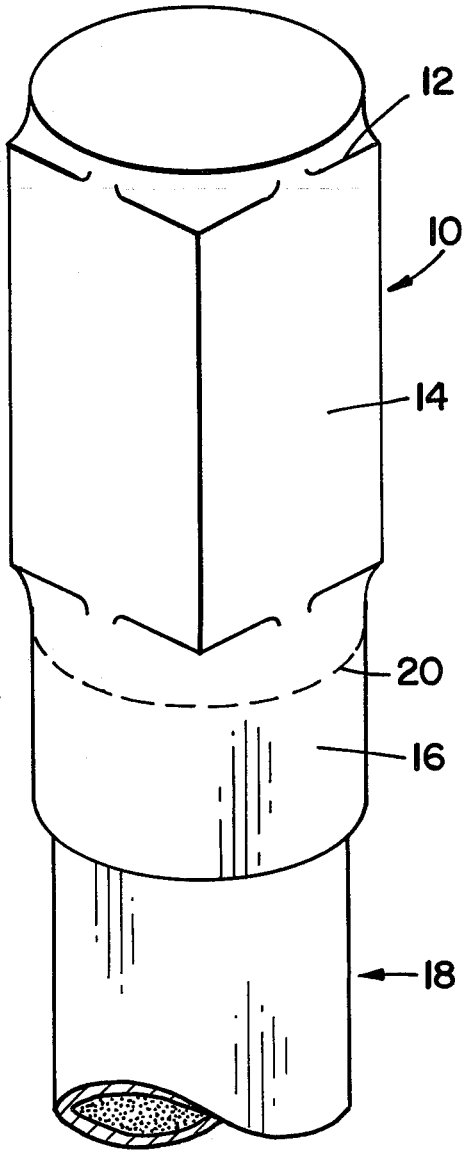
FIG. 2 is a perspective view of an end tip cup having a square cross-section formed by a die in the loading process.

The cup may also be formed at the same time as it is loaded with the explosive as illustrated by FIGS. 2 and 3. A cylindrical end tip cup 10' is placed in a die 22 having a cavity 24 of the desired configuration, such as a square cross-section. An explosive 26 is loaded into the cup 10' and a ram 28, equal to or a few mils less than the diameter of the inside of the cylindrical portion of the cup, applies a force to the explosive which is sufficient to deform the cup walls and force them against the die walls so that the cup takes on the shape of the die as shown. The shape of the tip as well as the shape of the walls of the cup 10' can be formed in this manner according to the particular requirement and appropriate die 22 used.

Figure 5A:
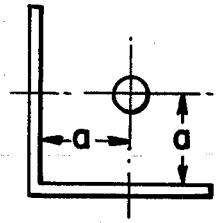
FIGS. 5(*a*) and 5(*b*) are diagrams of a test for determining the dispersion pattern of the fragments from (a) a standard cylindrical end tip and (b) a special rectilinear end tip.
Figure 5B:
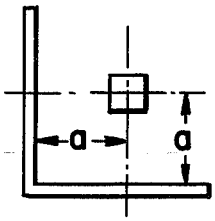
Figure 6A:
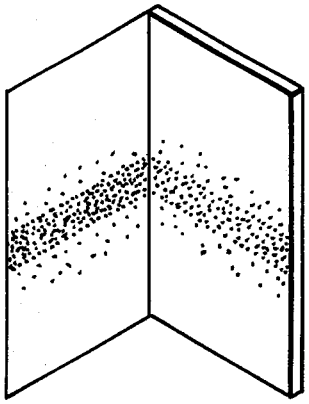
FIGS. 6(*a*) and 6(*b*) are diagrams of the fragment dispersion pattern resulting from the test of FIGS. 5(*a*) and 5(*b*).
Figure 6B:
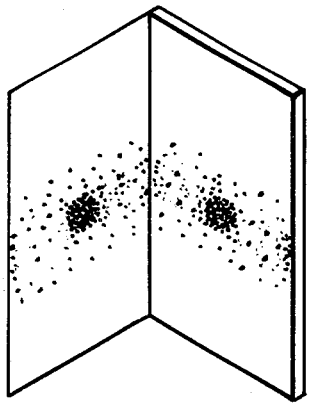

For example, a stainless steel cup was loaded with 135 mg of HNS-I explosive (hexanitrostilbene) in a brass die having a square cavity. Under pressure by the cylindrical ram of about 100,000 p.s.i., the cup took on the shape of the die cavity. As shown in FIGS. 5 and 6 when a standard cylindrical end tip and a special end tip with a square cross-section having the same amount of explosive were detonated adjacent an aluminum angle plate, the fragment pattern from the standard end tip was uniformly dispersed while the fragment pattern from the special end tip was concentrated opposite the flat sides. The results clearly illustrate the increased effectiveness of the special end tip across a gap, whether of air or vacuum, as well as when in contact.

As shown in FIG. 4 for various configurations, the detonation is transmitted in both directions as illustrated by the heavy arrows.

Thus, the present invention provides the ability of two-way detonation transmission around corners and at an acute angle due to the use of special end tips which are configured to be contiguous to each other at all points so the fragments are concentrated at the acceptor and achieve simultaneous impact.

I claim:

1. A method for transmitting detonations at a sharp angle in either direction comprising the step of shaping a donor and an acceptor end tip to a configuration such that when placed in contact with each other said donor and acceptor end tips are in planar contact, said shaping step being accomplished by;

(a) placing a cylindrical end tip cup in a die having a cavity of said configuration;

(b) loading an explosive into said cup; and (c) applying a force to said explosive sufficient to deform the walls of said cup against the walls of said die.

2. A method for transmitting detonations at a sharp angle in either direction comprising the step of shaping a donor and an acceptor end tip to a configuration such that when placed adjacent each other said donor and acceptor end tips have faces parallel to each other to transmit detonations across a gap, said shaping step being accomplished by:

(a) placing a cylindrical end tip cup in a die having a cavity of said configuration;

(b) loading an explosive into said cup; and (c) applying a force to said explosive sufficient to deform the walls of said cup against the walls of said die.

3. A method for transmitting detonations as recited in claims 1 and 2 wherein the step of applying said force comprises ramming said explosive with a ram which is equal to the inside diameter of said cup.

* * * * *